US005145006A

United States Patent [19]

June

[11] Patent Number: 5,145,006

[45] Date of Patent: Sep. 8, 1992

[54] TUBING HANGER AND RUNNING TOOL WITH PRELOADED LOCKDOWN

[75] Inventor: David R. June, Cypress, Tex.

[73] Assignee: Cooper Industries, Inc., Houston, Tex.

[21] Appl. No.: 722,061

[22] Filed: Jun. 27, 1991

[51] Int. Cl.[5] ..... E21B 23/00

[52] U.S. Cl. ..... 166/341; 166/77.5

[58] Field of Search ..... 166/338, 341-343, 166/348, 349, 351, 354, 368, 75.1, 77.5, 78

[56] References Cited

U.S. PATENT DOCUMENTS

| | | | |
|---|---|---|---|
| 3,693,714 | 9/1972 | Baugh | 166/0.6 |
| 4,067,062 | 1/1978 | Baugh | 166/125 |
| 4,067,388 | 1/1978 | Mouret et al. | 166/208 |
| 4,474,236 | 10/1984 | Kellett | 166/341 X |
| 4,478,287 | 10/1984 | Hynes et al. | 166/341 |
| 4,554,976 | 11/1985 | Hynes et al. | 166/341 |

*Primary Examiner*—Thuy M. Bui

*Attorney, Agent, or Firm*—Jackie Lee Duke; Alan R. Thiele; Eddie Scott

[57] ABSTRACT

An improved subsea tubing hanger having a body with an external shoulder for landing on a seat within a subsea wellhead housing, locking ring carried on the hanger to engage an interior recess of the wellhead housing, with an actuator ring for setting the locking ring. A preloading mechanism includes an extendible ring cooperating with the locking ring to prevent any movement of the tubing hanger when engaged and operable by torque supplied by the running tool. The improved tubing hanger running tool includes a body secured to the tubing hanger by conventional latching ring with a rotatable outer sleeve having an interior helical groove. A piston positioned on the running tool body and operated by hydraulic fluid pressure has an exterior pin which coacts with the helical groove to provide torque to the actuating ring and preloading ring of the tubing hanger.

7 Claims, 9 Drawing Sheets

TUBING HANGER AND RUNNING TOOL WITH PRELOADED LOCKDOWN

BACKGROUND

This invention relates to an improved tubing hanger and running tool with a preloaded lockdown of the tubing hanger to the wellhead housing which overcomes the disadvantages of prior subsea tubing hangers and running tools.

Tubing hangers are typically designed to support the weight of the associated tubing strings by landing on a seat within the wellhead housing. The tubing hanger is then locked in position by urging a split ring carried on the tubing hanger body into a recess in the wellhead housing interior wall which prevents upward movement of the tubing hanger. Due to manufacturing tolerances and debris which may have accumulated on the landing seat in the wellhead housing during prior drilling operations, it has been necessary to make the recess which the split ring engages longer than the split ring. This additional length allows room for the tubing hanger and split ring to reciprocate within the recess as the tubing string lengths grow or contract due to thermal stresses.

Once the running tool is removed from the tubing hanger and wellhead, residual torsional force exerted on the tubing hanger by the tubing strings suspended below can cause the tubing hanger to rotate with respect to the wellhead housing and move from its original orientation. This loss of orientation can damage or make it impossible to reinstall the running tool during subsequent tubing string operations or install the subsea tree subsequently. As drilling and production technology has allowed such operations in deeper water depths, operators have insisted on the use of metal-to-metal seals to seal the annulus between the tubing strings and the last casing string. These type of metal-to-metal seals are easily damaged by excessive movement after energization. The reciprocating and rotational motions described above are extremely deleterious to these metal-to-metal seals. The present invention overcomes these problems by providing a novel apparatus for preloading the tubing hanger and preventing reciprocating or rotational movement of the tubing hanger.

U.S. Pat. No. 3,693,714 to B. F. Baugh discloses a typical prior art tubing hanger and running tool which utilizes an expansible lock ring to secure the tubing against upward movement with respect to the wellhead housing.

U.S. Pat. No. 4,067,062 to B. F. Baugh is an example of a tubing hanger allowing use of multiple tubing strings and an associated hydraulic running tool which can run and lock the tubing hanger within the wellhead and is releasable therefrom. The running tool can be subsequently reconnected to the tubing hanger and hydraulically unlatch the tubing hanger and retrieve it to the surface.

U.S. Pat. No. 4,067,388 to E. M. Mouret discloses a running tool and tubing hanger combination which allows release of the tool from the tubing hanger by hydraulic pressure or rotation of the running string to which the tool is attached.

SUMMARY

An improved subsea tubing hanger having a body with an external shoulder for landing on a seat within a subsea wellhead housing, locking means carried on the hanger to engage a interior recess of the wellhead housing, with the locking means including a locking ring and a actuator ring for setting the locking ring. A preloading means includes a extendible ring cooperating with the locking ring to prevent any movement of the tubing hanger when engaged and operable by torque supplied by the running tool. The improved tubing hanger running tool includes a body secured to the tubing hanger by conventional latching means with a rotatable outer sleeve having an interior helical groove. A piston positioned on the running tool body and operated by hydraulic fluid pressure has an exterior pin which coacts with the helical groove to provide torque to the actuating ring and preloading means of the tubing hanger.

An object of the present invention is to provide an improved tubing hanger and running tool for lowering, landing and locking a tubing hanger within a subsea wellhead housing and preloading the lockdown mechanism to prevent any subsequent axial or rotational movement of the tubing hanger and its metal-to-metal seals relative to the wellhead housing.

Another object of the present invention is to provide an improved tubing hanger running tool which provides torque for operating the improved preload lockdown mechanism without transmitting the torque into the tubing hanger or its metal-to-metal seals.

BRIEF DESCRIPTION OF THE DRAWINGS

These and other objects and advantages of the present invention are set forth below and further made clear by reference to the drawings, wherein.

DESCRIPTION OF THE PREFERRED EMBODIMENT

Figure 1:
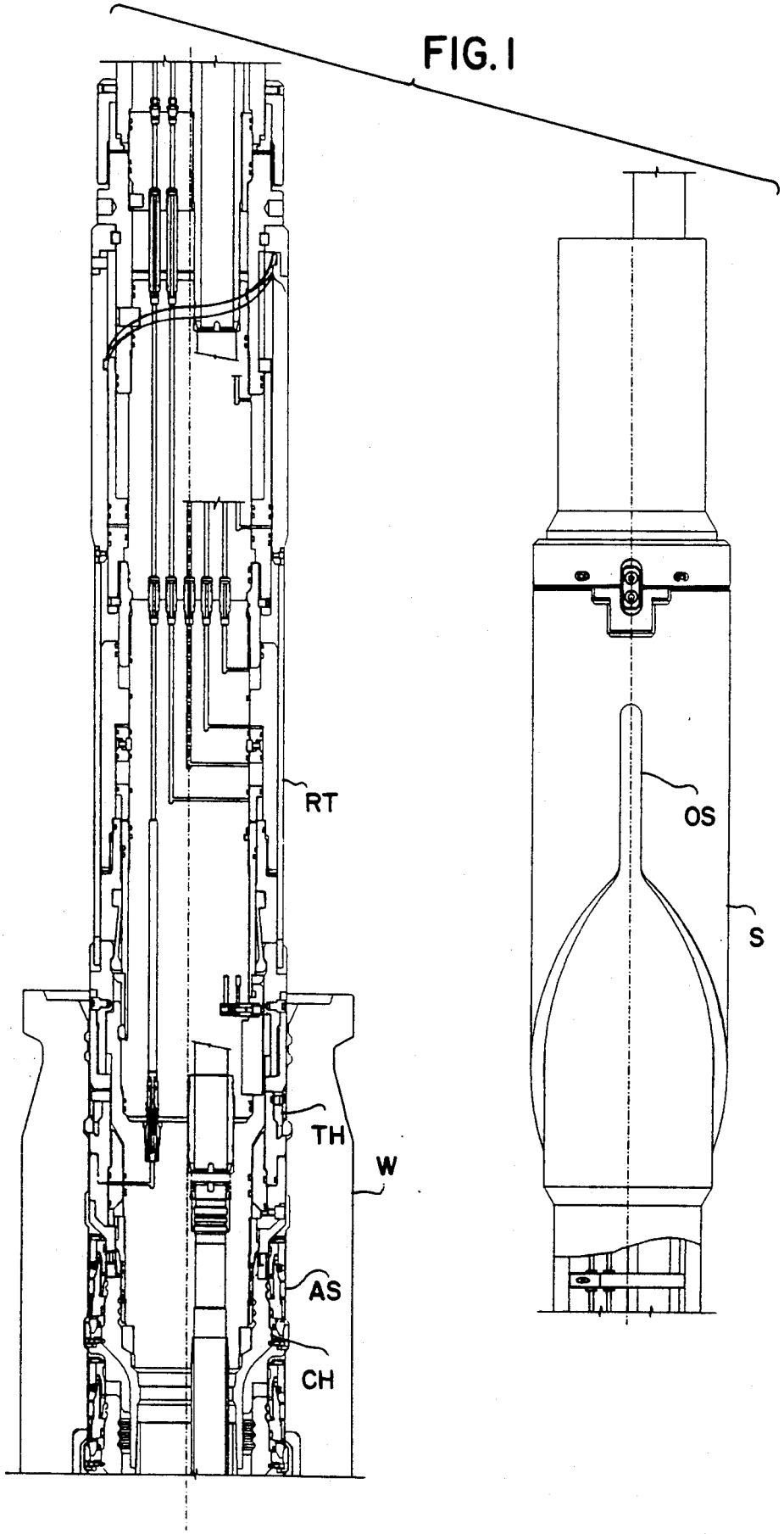
FIG. 1 is an elevation view, in full section, of the preferred embodiment of the improved tubing hanger and running tool with the tubing hanger in the locked position and the preload mechanism activated.

With reference to FIG. 1, subsea tubing hanger TH has been lowered on running tool RT into position within subsea wellhead W. Casing hanger CH has been previously landed within wellhead W and annulus pack-off assembly AS installed thereabout. A collet connector, blowout preventer stack and riser (not shown) are secured to the upper end of wellhead W in a manner well known to those skilled in the art with the riser extending to the surface for connection to a drilling rig (not shown) for drilling and production operations within the wellhead. Running tool RT has orienting sleeve S forming the upper end thereof with orientation slot OS formed therein for cooperation with an orienting pin (not shown) disposed in the bore of the blowout preventer to provide an orientation reference with respect to wellhead W.

Figure 2:
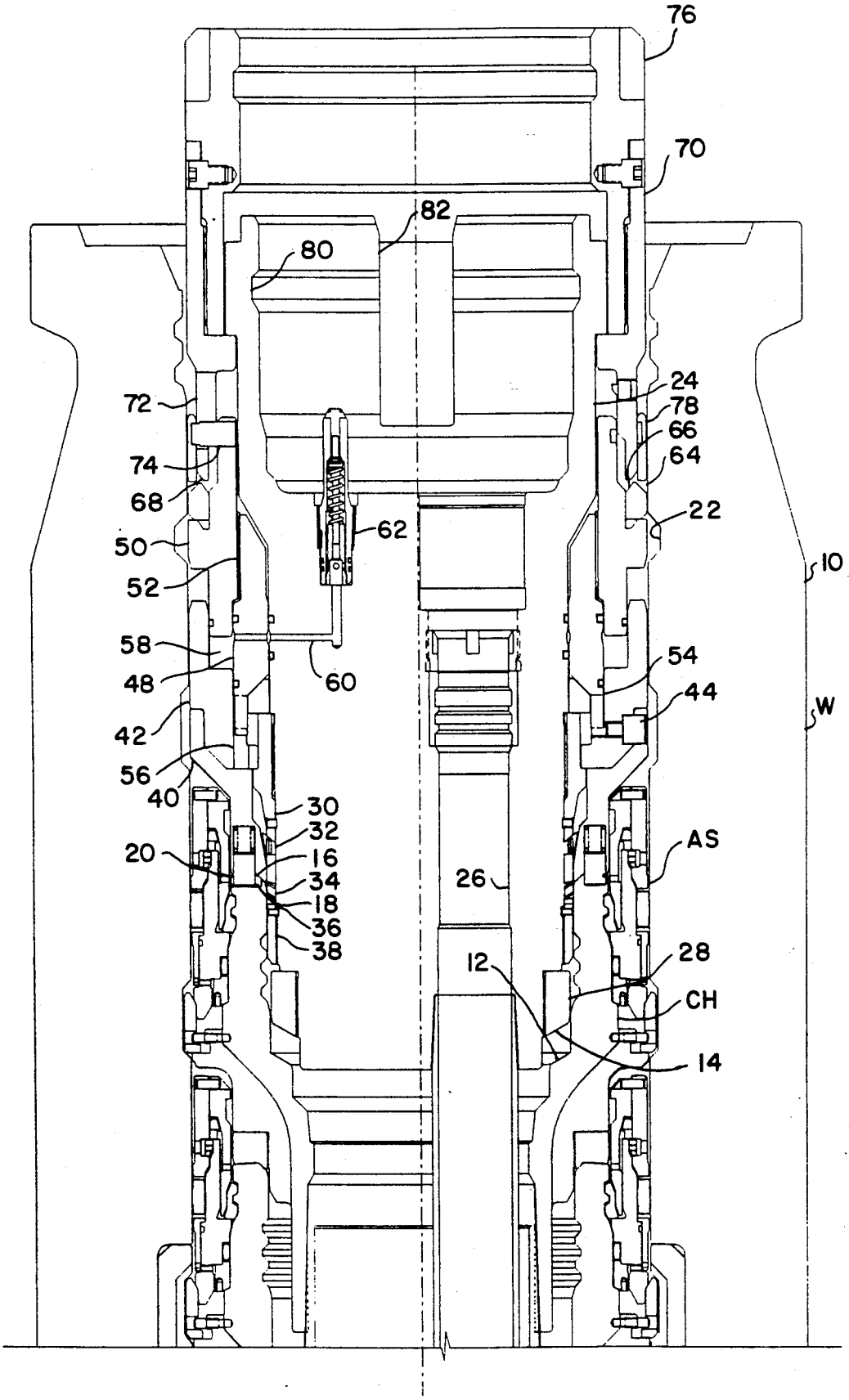
FIG. 2 is an enlarged elevation view of the tubing hanger landed in the wellhead housing with the running tool omitted for clarity prior to energizing of the metal-to-metal seal.

Referring to FIG. 2, wellhead W includes wellhead housing 10 with casing hanger CH landed therein having landing seat 12 therein for receiving shoulder 14 of tubing hanger TH. Casing hanger CH has upper face 16 with antirotation slot 18 formed therein for receiving antirotation pin 20 of tubing hanger TH. Wellhead housing 10 has locking recess 22 formed on its interior above casing hanger CH for coaction with tubing hanger TH as hereinafter described.

Tubing hanger TH includes body 24 with tubing passages 26 therethrough with only one of such passages being shown and lower ring 28 secured thereon having shoulder 14 sized to land within casing hanger CH on landing seat 12. Shoulder ring 30 is secured to the exterior of body 24 with camming ring 32, metal-to-metal seal 34, bearing ring 36 and retainer ring 38 which is also secured to body 24 therebelow. Landing ring 40 is positioned about shoulder ring 30 with antirotation pins 20 disposed in its lower face. Piston ring 42 is positioned above landing ring 40 and keyed together by suitable means, as shoulder screws 44. Immediately above piston ring 42 are torque ring 48 and lockdown backup ring 50 connected by thread 52. The lower end of torque ring 48 has tabs 54 which engage vertical slots 56 in piston ring 42 to prevent rotation therebetween while allowing relative axial movement. The interior and exterior of torque ring 48 and lockdown backup ring 50 have seals disposed thereon which seal against body 24 and piston ring 42 to form controlled landing chamber 58 which is connected by passage 60 to check valve 62 and operated by running tool RT in a manner to be described hereinafter.

Lock ring 64 is initially positioned on the exterior of lockdown backup ring 46 and has tapered inner surface 66 which is engaged by tapered surface 68 on actuator ring 70 to urge lock ring 64 into engagement with locking recess 22 of wellhead housing 10. Actuator ring 70 is of two part construction to facilitate assembly with lower slot 72 engaged by torque pins 74 to allow axial movement of actuator ring 70 with respect to lockdown backup ring 50 and transmitting torque thereto. Torque slots 76 are positioned on the upper face of actuator ring 70 for engagement by running tool RT. Protector ring 78 is held in position immediately above lock ring 64 on torque pins 74 to prevent premature activation of ring 78 during running.

The upper face of tubing hanger body 24 is counterbored with latch groove 80 positioned therein for connection of running tool RT. Orientation slot 82 is vertically oriented in body 24 for engagement by running tool RT in a manner well known to those skilled in the art.

Referring to FIGS. 5A–5E, running tool RT includes lower body 84, upper body 86 and orientation body 88 with lower body 84 and upper body 86 held in abutting relationship by two part piston nut 90. Control passages **92*c*–92*g* extend through lower body 84 and upper body 86 with seal subs 94 providing a continuous fluid path. Control passages 92*a*–92*e* are shown radially arranged for descriptive purposes but are actually arranged radially and circumferentially to fit within bodies 84 and 86. Lower body 84 and upper body 86 are maintained in proper orientation by seal subs 94. Upper body 86 and orientation body 88 are connected by nut assembly 96 with orientation pins 98 maintaining alignment. Orientation body 88 has orienting sleeve S secured thereto and terminates with handling sub 100**.

Torque sleeve 102 is held on running tool RT by bearing ring 104 and is rotatable thereon with splines 106 formed on the lower end thereof for engagement with torque slots 76 of actuator ring 70. Helical groove 108 is formed on the interior of torque sleeve 102 with pin 110 of torque piston 112 guided therein. Torque piston 112 is antirotated with respect to upper body 86 by key 114 axially movable within vertical slot 116. Torque piston 112 has interior and exterior seals disposed thereon which seal against upper body 86 and torque sleeve 102 to form torque chamber 118 which receives hydraulic fluid pressure through control passage **92*a*. Piston nut 90 has interior and exterior seals disposed thereon which seal against upper body 86 and torque sleeve 102 to form untorque chamber 118 which receives hydraulic fluid pressure through control passage 92*b*. When hydraulic fluid pressure is supplied through control passages 92*a* or 92*b*, torque piston 112 is constrained to move up or down accordingly. Simultaneously, pin 110 is moving in helical groove 108 thereby causing torque sleeve 102 which is free to rotate on upper body 86, to transmit its torque through torque slots 76 and splines 106 to actuator ring 70. Actuator ring 70 transmits this torque through torque pins 74 to lockdown backup ring 50. Since torque ring 48, piston ring 42, and landing ring 40 are antirotated with respect to casing hanger CH, lockdown backup ring 50 is urged upwardly to contact lock ring 64** and establish the desired preloaded connection.

Piston stop ring 120 is positioned axially below piston nut 90 and secured on lower body 84. Locking piston 122 is disposed radially outwardly from piston stop ring 120 and is of two part construction to facilitate assembly. Interior groove 124 of locking piston 122 receives unlocking segments 126 therein with latching piston 128 closely fitting behind unlocking segments 126 to ensure their retention within groove 124. Piston nut 90, piston stop ring 120 and locking piston 122 have seals disposed thereon which seal against lower body 84 and torque sleeve 102 to form tubing hanger locking chamber 130 and tubing hanger unlocking chamber 132 which receive hydraulic fluid pressure from control passages **92*c* and 92*d***, respectively.

Similarly, piston stop ring 120, locking piston 122 and latching piston 128 have seals disposed thereon which seal against lower body 84 to form running tool latching chamber 134 and running tool unlatching chamber 136 which receive hydraulic fluid pressure from control passages **92*e* and 92*f*, respectively. Running tool latch ring 138 is disposed on the lower portion of running tool RH and is cammed into engagement with latch groove by latching piston 128 as described hereinafter. Ring 140 is positioned immediately above latch ring 138 and prevents premature actuation of latch ring 138 during running and retrieving of the running tool RT. Orientation key 142 is secured to the lower end of body 84 and coacts with orientation slot 82, as best seen in FIG. 2, to duplicate alignment of tubing passages 26 when running tool RT is inserted in tubing hanger TH. Control passage 92*g* extends through running tool RT and aligns with control valve 62 when running tool RT is inserted in tubing hanger TH. Tubing sub 144 is positioned in tubing passage 26 of running tool RT and extends into corresponding tubing passage 26 of tubing hanger TH. Adjacent orientation key 142 is poppet valve 146 to which control passages 92*c* and 92*h* are connected and which coacts with actuator ring 70** in a manner to be described hereinafter to provide a surface indication of positive locking of the tubing hanger TH at the surface.

Figure 3:
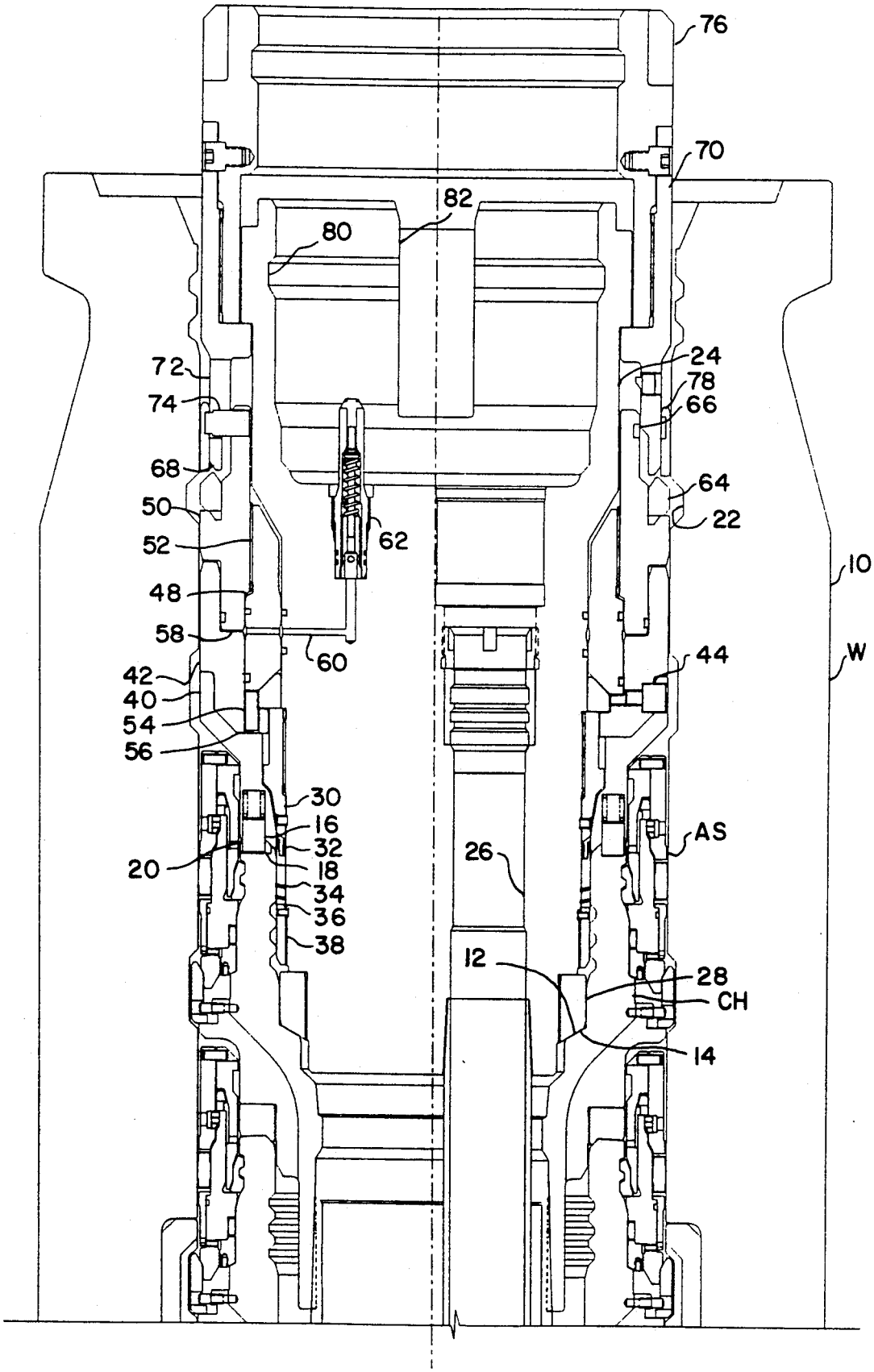
FIG. 3 is a view similar to FIG. 2 with the metal-to-metal seal energized.
Figure 4:
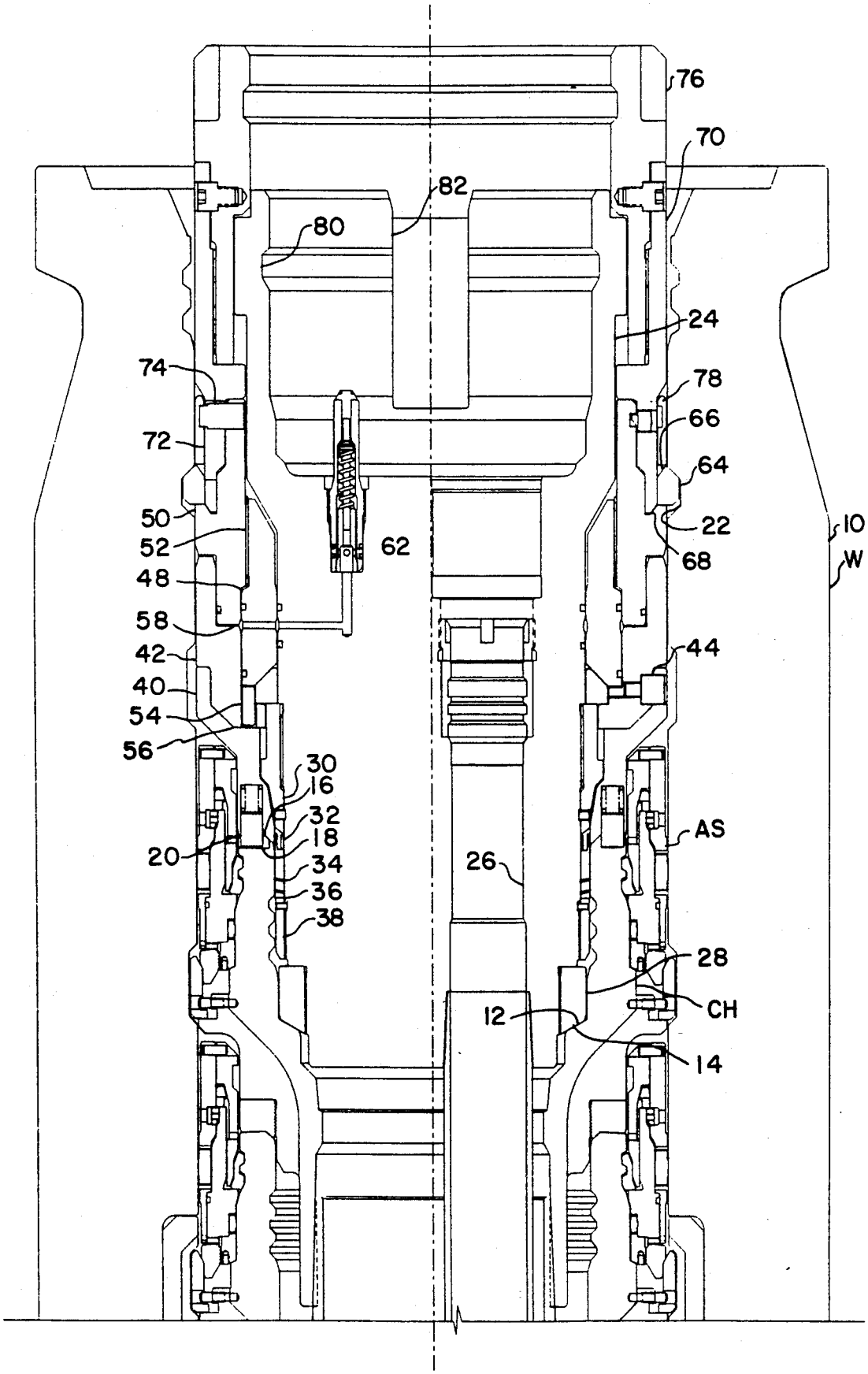
FIG. 4 is a view similar to FIG. 3 with the tubing hanger lockdown engaging the internal recess of the wellhead housing and the tubing hanger preload activated.

A typical sequence of events for using the improved tubing hanger and running tool with a preloaded lockdown is as follows. The tubing hanger TH and running tool RT are assembled as shown in FIGS. 5A–5E with latching piston 128 extended by hydraulic fluid pressure in running tool latching chamber 134 which urges running tool latch ring 138 into engagement with latch groove 80 in tubing hanger TH. Hydraulic fluid pressure is then applied to control passage 92*g*, through check valve 62 and passage 60 to controlled landing chamber 58. This causes landing ring 40 and piston ring 42 to move downward until the inner edge of piston ring 42 is stopped by shoulder ring 30. Hydraulic fluid pressure is also applied to control passage 92*d* and hence tubing hanger unlocking chamber 132 which ensures actuator ring 70 is maintained in the unlocked position until the appropriate time. These operations place actuator ring 70 and landing ring 40 and piston ring 42 in the position shown in FIG. 2. The tubing hanger TH and running tool RT are then run into the wellhead W in a conventional manner until landing ring 40 contacts upper face 16 of casing hanger CH at which time the assembly is rotated until antirotation pin 20 engages antirotation slot 18. In this position, the metal-to-metal seal 34 is held up out of contact with casing hanger CH. The pressure in controlled landing chamber 58 is then released allowing the tubing hanger TH and running tool RT to descend to the position shown in FIG. 3 whereby camming ring 32 has engaged the tapered inner surface of landing ring 40 and activated metal-to-metal seal 34 into sealing engagement with casing hanger CH. Simultaneously, tubing hanger body 24 has moved downward allowing shoulder 14 to contact landing seat 12 of casing hanger CH and placing lock ring 64 adjacent locking recess 22.

Figure 5A:
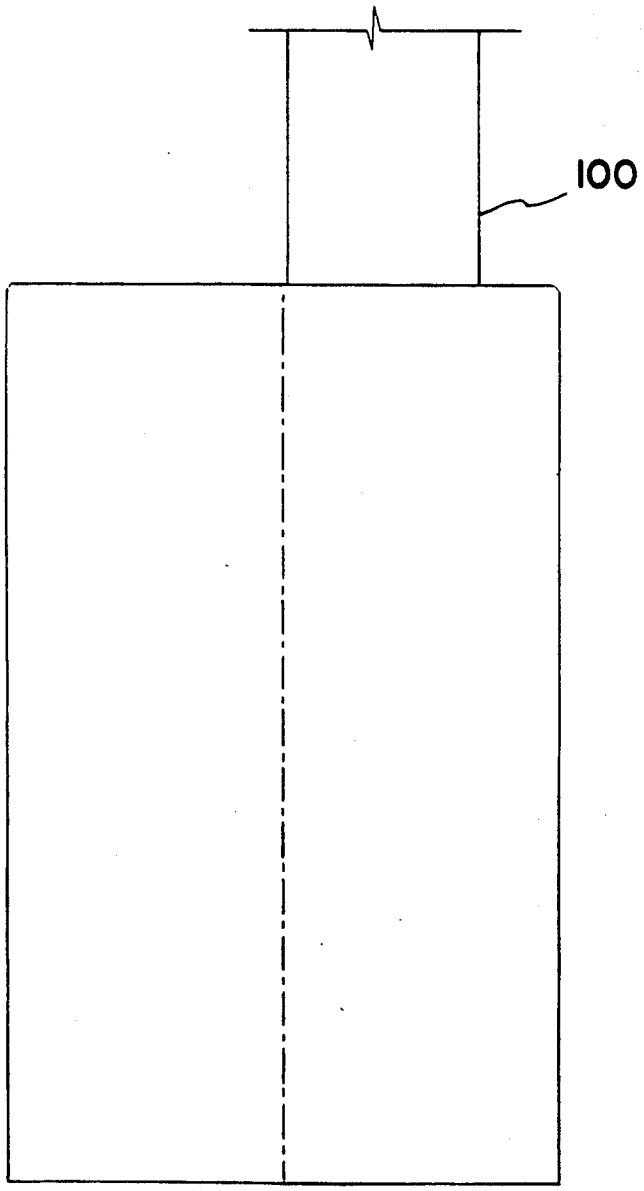
FIGS. 5A, 5B, 5C, 5D and 5E are views similar to FIG. 1 on an enlarged scale showing the wellhead housing, tubing hanger and running tool in greater detail with the FIGURES arranged left to right, with FIG. 5A being the leftmost and FIG. 5E being the rightmost.
Figure 5B:
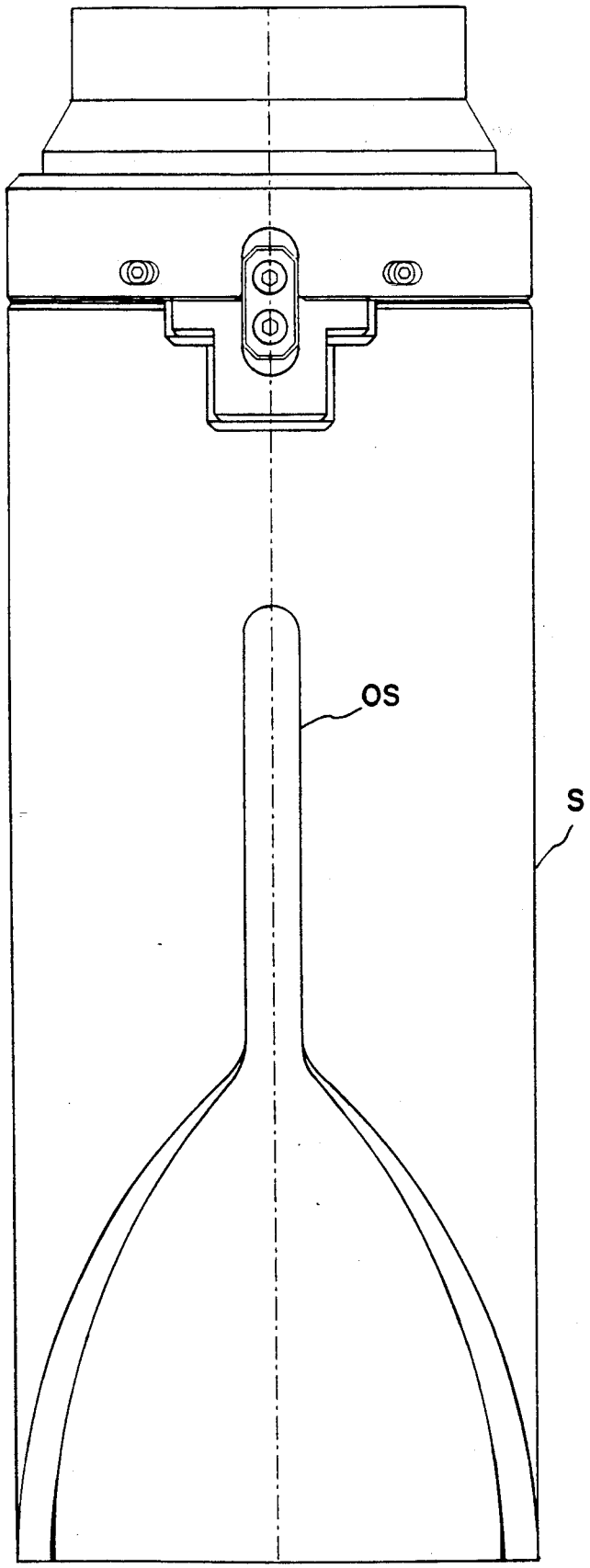
Figure 5C:
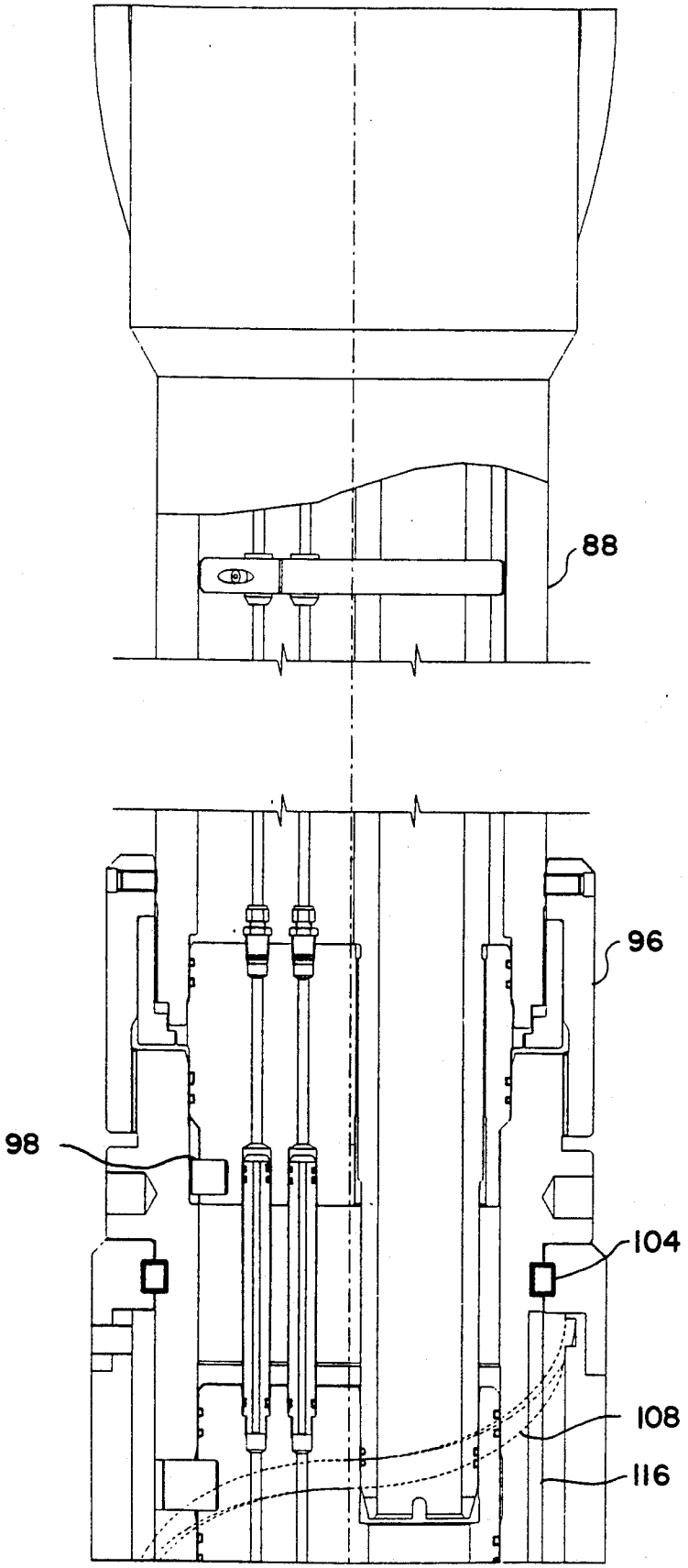
Figure 5D:
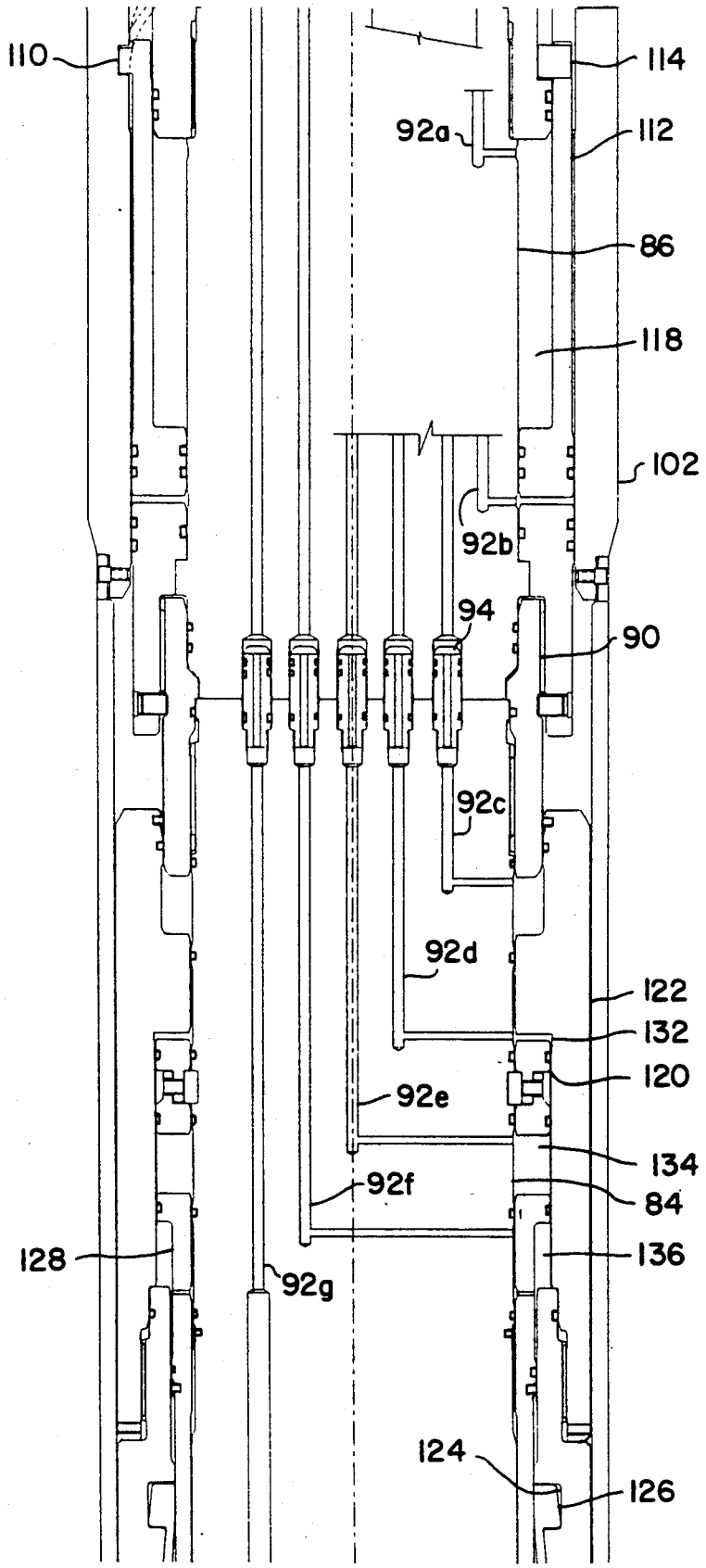
Figure 5E:
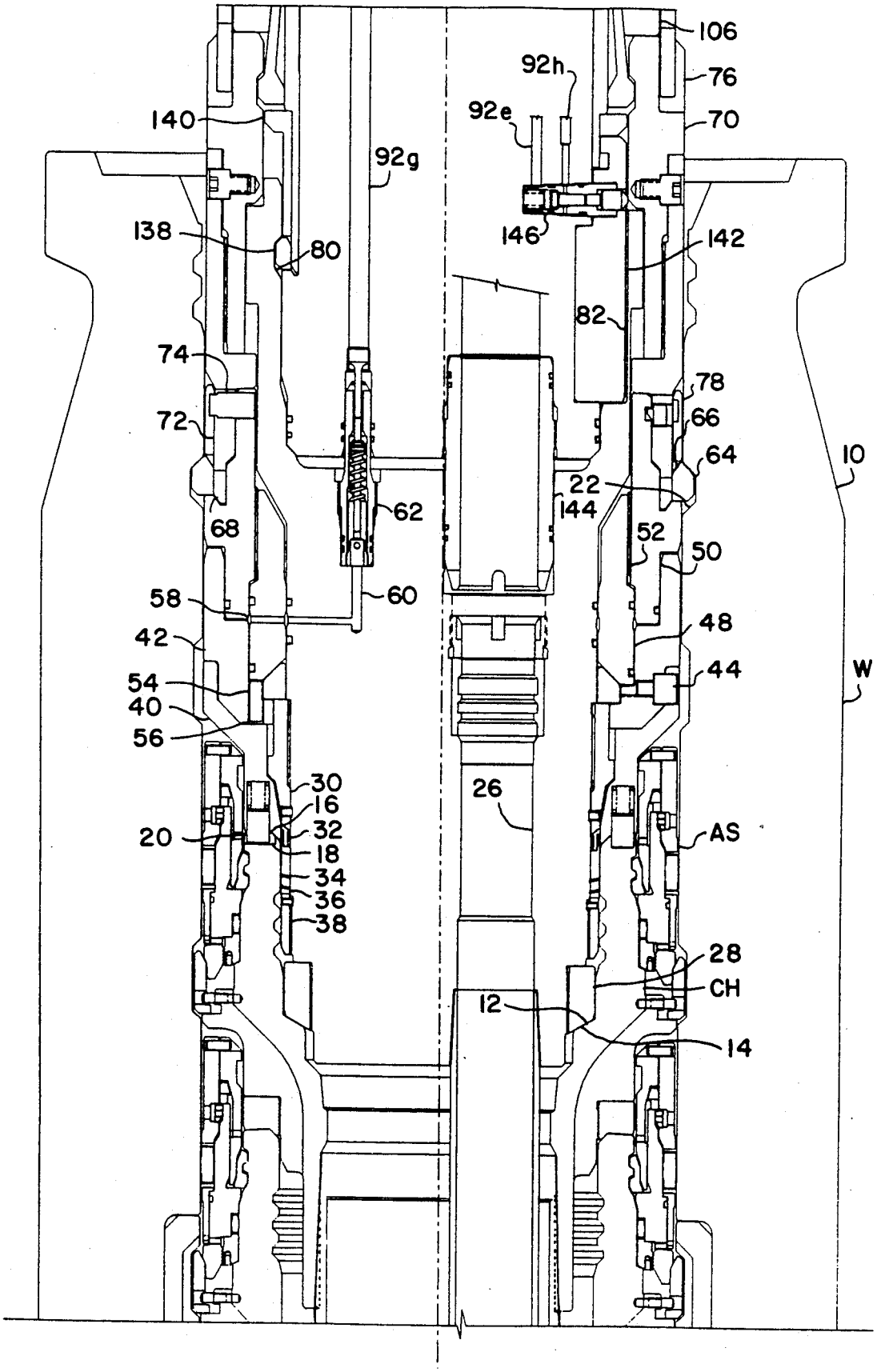

Hydraulic fluid pressure is applied to control passage 92*c* and tubing hanger locking chamber 130 thereby urging torque piston 122 and actuator ring 70 downwardly to cam lock ring 64 into locking recess 22 as seen in FIG. 5E. As actuator ring 70 reaches its final locked position, its inner edge operates poppet valve 146 to direct the hydraulic fluid pressure in control passage 92*c* to passage 92*h* which is vented to the surface where, typically a pressure gauge is attached. An increase in hydraulic fluid pressure on this gauge provides a reliable indicator the tubing hanger is securely locked.

At this point if it is desired to release running tool RT from tubing hanger TH, hydraulic fluid pressure is applied to control passage 92*f* thereby urging latching piston 128 upwardly and releasing latch ring 138 from recess 80 allowing running tool RT to be retrieved to the surface. In this case a mechanical torque tool which has tabs on its lower end to engage torque slots 76 can be run on drillpipe and used to rotate torque ring 48 to its final preloaded position. If the running tool RT was left in place, hydraulic fluid pressure is then applied to control passage 92*a* to cause torque sleeve 102 to rotate and urge torque ring 48 to its final preloaded position in contact with locking ring 64 which is contacting locking recess 22. Running tool RT is then released from tubing hanger TH as previously described. Should it be desired to remove tubing hanger TH, running tool RT is rerun in a manner well known to those skilled in the art with orientation key 142 engaging slot 82 to ensure proper orientation upon reentry. The running tool RT can then be relatched to the tubing hanger TH and the tubing hanger TH unlocked from the wellhead housing 10 by pressurizing tubing hanger unlocking chamber 132 without the need to release or untorque the tubing hanger preload.

What is claimed is:

1. An improved preloaded lockdown mechanism for a subsea tubing hanger having a running tool latched thereto for use in a subsea wellhead housing having a blowout preventer and a riser above the blowout preventer, comprising:

a landing seat and a locking recess within said wellhead housing, a landing shoulder on said tubing hanger for landing on said landing seat with said wellhead housing, a locking means positioned on said tubing hanger for actuation to engage said locking recess and thereby secure said tubing hanger within said wellhead housing, and a preloading means positioned on said tubing hanger and cooperating with said locking means to preload said locking means and prevent relative movement between said tubing hanger and said wellhead housing.

2. An improved preloaded lockdown mechanism according to claim 1 wherein said locking means includes:

a locking element, an actuating means positioned on said tubing hanger and axially slideable thereon for movement with respect to said locking element to urge said locking element radially into engagement with said locking recess, a piston positioned on said running tool and operable by hydraulic fluid pressure to move said actuating means between locked and unlocked positions.

3. An improved preloaded lockdown mechanism according to claim 2 wherein said preloading means includes:

an external shoulder on said tubing hanger, an extendible ring with an external shoulder for cooaction with said locking element and an internal shoulder positioned on said external shoulder of said tubing hanger, said ring being extended after said locking element is in said locking recess to generate a preloaded lockdown connection between said locking recess and said landing seat of said wellhead housing when said tubing hanger is landed on said landing seat.

4. An improved preloaded lockdown mechanism according to claim 3 wherein said extendible ring includes:

an inner portion and an outer portion threadably engaged to provide relative axial movement therebetween, said actuating means of said locking means includes an actuating ring keyed to said extendible ring whereby rotation of said actuating ring urges said extendible ring to a preloaded position.

5. An improved preloaded lockdown mechanism according to claim 4 wherein:

said tubing hanger includes antirotation means thereon coacting with said landing seat of said wellhead housing to prevent rotation therebetween, said inner ring of said extendible ring is keyed to said external shoulder of said tubing hanger to prevent rotation of said inner ring when said outer ring is urged to a preloaded position.

6. An improved preloaded lockdown mechanism according to claim 5 wherein said running tool includes:

a body with an antirotation key for engagement with an antirotation slot on said tubing hanger to prevent relative rotation therebetween, an outer sleeve rotatable on said running tool body with splines for engagement with mating slots on said actuating ring and an interior helical groove, a piston positioned on said running tool and operable by hydraulic fluid pressure with an exterior pin engaging said interior helical groove and an interior pin preventing rotation of said piston with respect to said running tool body whereby movement of said piston causes rotation of said outer sleeve and thereby urges said actuating ring and inner ring of said extendible ring to a preloaded position.

7. An improved preloaded lockdown mechanism according to claim 6 wherein said running tool further includes:

an orienting means cooperating with an orientation pin within said blowout preventer to ensure a preferred orientation of said running tool and said tubing hanger with respect to said wellhead housing.

* * * * *